US009379428B2

(12) United States Patent
Su et al.

(10) Patent No.: US 9,379,428 B2
(45) Date of Patent: Jun. 28, 2016

(54) ANTENNA STRUCTURE AND WIRELESS COMMUNICATION DEVICE

(71) Applicant: Chiun Mai Communication Systems, Inc., New Taipei (TW)

(72) Inventors: Wei-Cheng Su, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 316 days.

(21) Appl. No.: 14/050,942

(22) Filed: Oct. 10, 2013

(65) Prior Publication Data

US 2014/0320350 A1 Oct. 30, 2014

(30) Foreign Application Priority Data

Apr. 30, 2013 (TW) ..... 102115325 A

(51) Int. Cl.

| | |
|---|---|
| ***H01Q 1/24*** | (2006.01) |
| ***H01Q 1/36*** | (2006.01) |
| ***H01Q 9/04*** | (2006.01) |
| ***H01Q 5/328*** | (2015.01) |

(52) U.S. Cl.

CPC ..... *H01Q 1/243* (2013.01); *H01Q 1/36* (2013.01); *H01Q 5/328* (2015.01); *H01Q 9/0414* (2013.01)

(58) Field of Classification Search

CPC ..... H01Q 1/38; H01Q 9/26; H01Q 1/243; H01Q 9/0421

USPC ..... 343/702, 878, 700 MS, 806

See application file for complete search history.

(56) References Cited

U.S. PATENT DOCUMENTS

| | | | | |
|---|---|---|---|---|
| 2010/0271282 | A1* | 10/2010 | Eom | H01Q 1/48 343/873 |
| 2011/0267245 | A1* | 11/2011 | Park | H01Q 1/243 343/722 |
| 2011/0298669 | A1* | 12/2011 | Rao | H01Q 1/243 343/702 |
| 2012/0013511 | A1* | 1/2012 | Sumi | H01Q 1/243 343/702 |

* cited by examiner

*Primary Examiner* — Dameon E Levi
*Assistant Examiner* — Collin Dawkins
(74) *Attorney, Agent, or Firm* — ScienBiziP, P.C.

(57) ABSTRACT

An antenna structure includes a feed end, a ground end, a number of antenna units, and a number of connection sections corresponding to the antenna units. The antenna units are positioned side by side. Each connection section is positioned between two adjacent antenna units and interconnects the two adjacent antenna units to form a zigzag-shaped antenna structure. The feed end and the ground end are perpendicularly connected to two antenna units positioned at two ends of the interconnected antenna units.

11 Claims, 3 Drawing Sheets

ANTENNA STRUCTURE AND WIRELESS COMMUNICATION DEVICE

BACKGROUND

1. Technical Field

The disclosure generally relates to antenna structures, and particularly to a multiband antenna structure and a wireless communication device using the multiband antenna.

2. Description of Related Art

To communicate in multi-band communication systems, a bandwidth of an antenna of a wireless communication device such as a mobile phone should be wide enough to cover frequency bands of the multi-band communication systems. In addition, because of the miniaturization of the wireless communication device, available space for the antenna is reduced and limited. Therefore, it is necessary to design the antenna having the wider bandwidth within the reduced and limited space.

Therefore, there is room for improvement within the art.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the disclosure.

DETAILED DESCRIPTION

Figure 1:
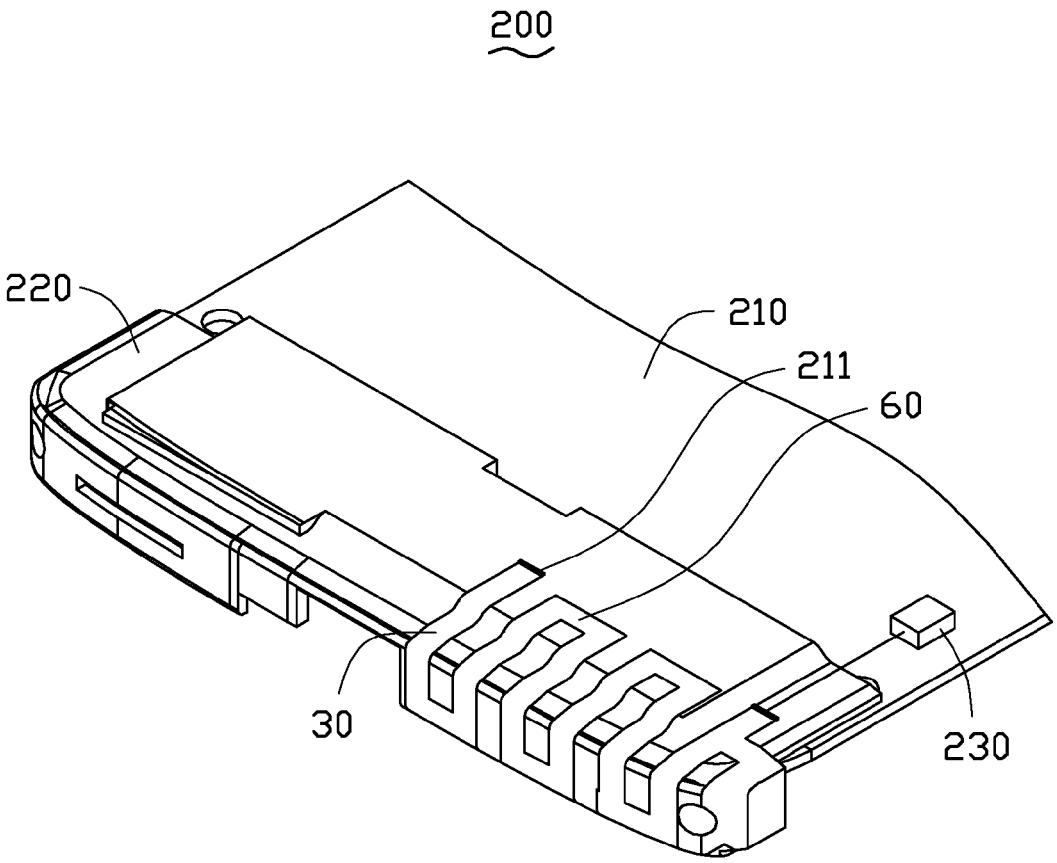
FIG. 1 is a schematic view of a wireless communication device including an antenna structure, according to an exemplary embodiment of the disclosure.

FIG. 1 is a schematic view of a wireless communication device 200, according to an exemplary embodiment of the disclosure. The wireless communication device 200 can be a mobile phone, or a personal digital assistant (PDA), for example. The wireless communication device 200 includes an antenna structure 100, a motherboard 210, and a carrier 220. The motherboard 210 includes a feed point 211 and a matching circuit 230 (schematically shown in FIG. 1). In this exemplary embodiment, the carrier 220 is made of plastic and positioned at one end of the motherboard 210. The antenna structure 100 is assembled to the carrier 220.

The antenna structure 100 includes a feed end 10, a ground end 20, and a plurality of antenna units 30, and a plurality of connection sections 60 orderly connected between two adjacent antenna units 30. In this exemplary embodiment, the number of the antenna units 30 is three, and the number of the connection sections 60 is two.

Figure 2:
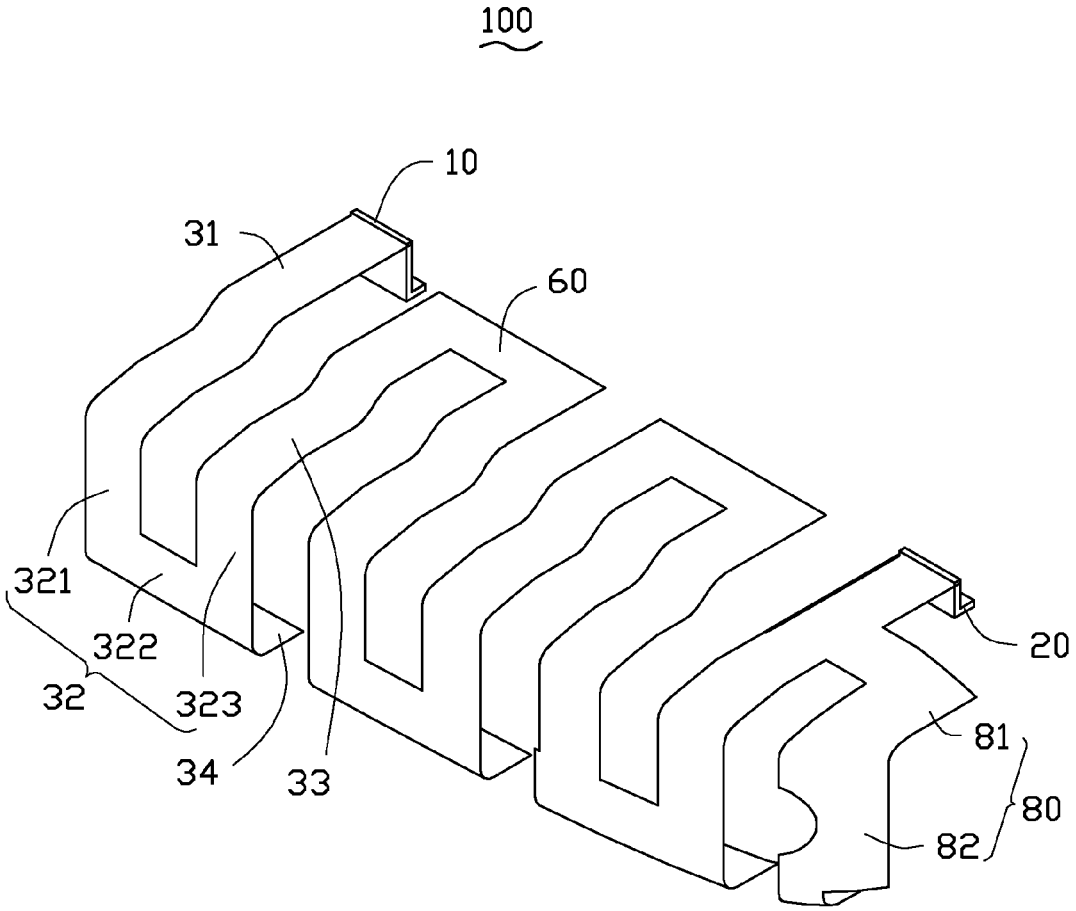
FIG. 2 is a schematic view of the antenna structure, according to an exemplary embodiment of the disclosure.

FIG. 2 shows that each antenna unit 30 includes a first radiating arm 31, a radiating body 32, and a second radiating arm 33 opposite to the first radiating arm 31.

The radiating body 32 is a substantial U-shaped sheet including a first radiating section 321, a second radiating section 322, and a third radiating section 323 opposite to the first radiating section 321. The second radiating section 322 is perpendicularly connected between the first radiating section 321 and the second radiating section 322, to form the U-shaped radiating body 32. The first radiating arm 31 and the second radiating arm 33 are substantially perpendicularly connected to the first radiating section 321 and the third radiating section 323, correspondingly.

In this exemplary embodiment, to match a surface of the carrier 220, some of the first radiating arms 31 and the second radiating arms 33 are bent in middle portions to form a substantial step-shaped portion.

Moreover, to make each of the antenna units 30 be stably assembled to the carrier 220, each antenna unit 30 further includes a latching portion 34. The latching portion 34 is a substantial rectangular sheet perpendicularly extending from one side of the second radiating section 322 opposite to the first radiating arm 31 and the second radiating arm 33.

Each connection section 60 is a substantially rectangular sheet. Each connection section 60 is positioned between two adjacent antenna units 30. One end of the connection section 60 is perpendicularly connected to the second radiating arm 33 of one of the two adjacent antenna units 30. Another end of the connection section 60 is perpendicularly connected to the first radiating arm 31 of the other of the two adjacent antenna units 30. Therefore, the antenna units 30 are interconnected by the connection sections 60 and form the zigzag-shaped antenna structure.

The feed end 10 and the ground end 20 are substantial L-shaped sheets. The feed end 10 is perpendicularly connected to the first radiating arm 31 of an initial antenna unit 30. The ground end 20 is perpendicularly connected to the second radiating arm 33 of a rear antenna unit 30. The initial antenna unit 30 and the rear antenna unit 30 are positioned at two ends of the interconnected antenna units 30.

Figure 3:
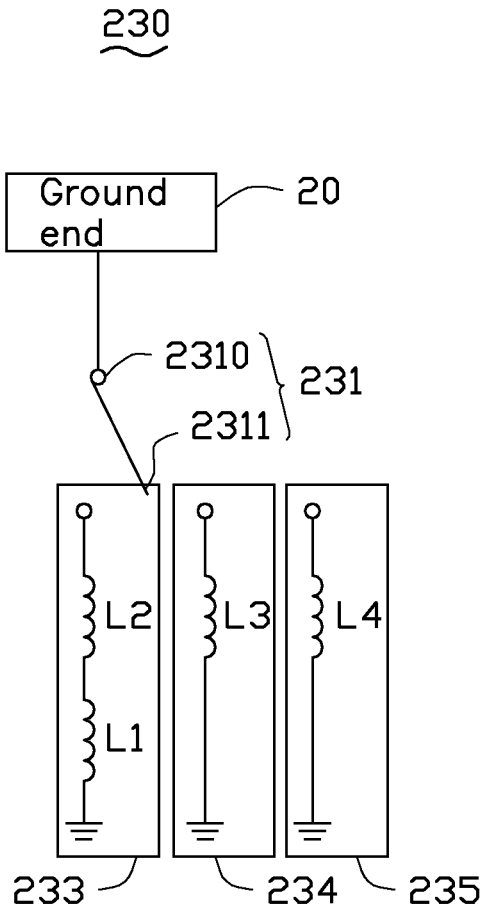
FIG. 3 is a circuit diagram of a matching circuit of the wireless communication device, according to an exemplary embodiment of the disclosure.

FIG. 3 shows that the antenna structure 100 further includes an adjusting portion 80 extending from one side of the rear antenna 30. The adjusting portion 80 includes a first adjusting section 81 and a second adjusting section 82 connected to the first adjusting section 81. In this exemplary embodiment, the first adjusting section 81 is a rectangular sheet substantially coplanar with the second radiating arm of the rear antenna 30, and the second adjusting section 82 is an irregular-shaped sheet to fit to the surface of the carrier 220. A radiation efficiency of the antenna structure 100 can be adjusted by changing dimensions of the adjusting portion 80 so the antenna structure 100 can have a better radiation effect.

FIG. 3 shows that the matching circuit 230 includes a switch 231, a first matching unit 233, a second matching unit 234, and a third matching unit 235. The switch 231 includes a common contact 2310 and a switch contact 2311. The common contact 2310 is electronically connected to the ground end 20. The switch contact 2311 is switched among the first matching unit 233, the second matching unit 234, and the third matching unit 235.

In this exemplary embodiment, when the switch contact 2311 is idled and the ground end 20 is open, the antenna structure 100 can work at a first communication system (e.g. LTE band 17). The first matching circuit 233 includes a first inductor L1 and a second inductor L2 connected in series. When the switch contact 2311 is switched to the first matching unit 233, the ground end 20 is grounded by the first inductor L1 and the second inductor L2, the antenna structure 100 can work at a second communication system (e.g. LTE band 13) The second matching circuit 234 includes a third inductor L3. When the switch contact 2311 is switched to the second matching unit 234, the ground end 20 is grounded by the third inductor L3, the antenna structure 100 can work at a third communication system (e.g. GSM 850). The third matching circuit 235 includes a fourth inductor L4. When the switch contact 2311 is switched to the third matching unit 235, the ground end 20 is grounded by the fourth inductor L4, the antenna structure 100 can work at a fourth communication system (e.g. GSM 900). Therefore, the antenna structure 100 can work at multiple communication systems (e.g. LTE Band 17, LTE Band 13, GSM850, and GSM900) by switching the switch 231 among different matching units (i.e. the first to third matching units). In this exemplary embodiment, the inductances of the first, second, third, and fourth inductors are about 120 nH, 120 mH, 75 nH, and 45 nH, respectively.

In use, when the antenna structure 100 works at the first communication system (e.g. LTE Band 17), the switch 231 is open. Current is fed into the antenna structure 100 from the feed point 211. Accordingly, when the antenna structure 100 works at the second, third, and fourth communication systems (e.g. LTE Band 13, GSM 850, and GSM 900), the switch 231 is switched to the first, second, and third matching units 233, 234, 245, correspondingly. The current is fed into the antenna structure 100 from the feed point 211, and then flows to the antenna units 30 and the first, second, and third matching units 233, 234, 245, correspondingly.

The antenna structure 100 employs a zigzag structure which can occupy less space in the portable electronic device 200. Meanwhile, the antenna structure 100 can work at the multiple communication systems by switching among different matching circuits and has a widen bandwidth.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An antenna structure, comprising:

a feed end;

a ground end;

a plurality of antenna units positioned side by side; and a plurality of connection sections corresponding to the antenna units, each connection section positioned between two adjacent antenna units and interconnecting the two adjacent antenna units to form a zigzag-shaped antenna structure, the feed end and the ground end perpendicularly connected to two antenna units positioned at two ends of the interconnected antenna units;

wherein each antenna unit comprises a radiating body, the radiating body comprises a first radiating section, a second radiating section, and a third radiating section opposite to the first radiating section, the second radiating section is perpendicularly connected between the first radiating section and the third radiating section; and wherein each antenna unit further comprises a latching portion perpendicularly extending from one side of the second radiating section.

2. The antenna structure of claim 1, wherein each antenna unit comprises a first radiating arm and a second radiating arm opposite to the first radiating arm; the first radiating arm and the second radiating arm are perpendicularly connected to the radiating body.

3. The antenna structure of claim 2, wherein the first radiating arm and the first radiating arm are substantially perpendicularly connected to the first radiating section and the third radiating section, correspondingly.

4. The antenna structure of claim 3, wherein some of the first radiating arms and the second radiating arms are bent in middle portions to form a substantial step-shaped portion.

5. The antenna structure of claim 3, wherein one end of the connection section is perpendicularly connected to the second radiating arm of one of the two adjacent antenna units; another end of the connection section is perpendicularly connected to the first radiating arm of the other of the two adjacent antenna units the connection section.

6. A wireless communication device, comprising:

a carrier; and an antenna structure positioned on the carrier, the antenna structure comprising:

a feed end;

a ground end;

a plurality of antenna units positioned side by side; and a plurality of connection sections corresponding to the antenna units, each connection section positioned between two adjacent antenna units and interconnecting the two adjacent antenna units to form a zigzag-shaped antenna structure, the feed end and the ground end perpendicularly connected to two antenna units positioned at two ends of the interconnected antenna units;

wherein each antenna unit comprises a radiating body, the radiating body comprises a first radiating section, a second radiating section, and a third radiating section opposite to the first radiating section, the second radiating section is perpendicularly connected between the first radiating section and the third radiating section; and wherein each antenna unit further comprises a latching portion perpendicularly extending from one side of the second radiating section.

7. The wireless communication device of claim 6, wherein each antenna unit comprises a first radiating arm and a second radiating arm opposite to the first radiating arm; the first radiating arm and the second radiating arm are perpendicularly connected to the radiating body.

8. The wireless communication device of claim 7, wherein the first radiating arm and the first radiating arm are substantially perpendicularly connected to the first radiating section and the third radiating section, correspondingly.

9. The antenna structure of claim 8, wherein some of the first radiating arms and the second radiating arms are bent in middle portions to form a substantial step-shaped portion.

10. The wireless communication device of claim 8, wherein one end of the connection section is perpendicularly connected to the second radiating arm of one of the two adjacent antenna units; another end of the connection section is perpendicularly connected to the first radiating arm of the other of the two adjacent antenna units the connection section.

11. The wireless communication device of claim 6, further comprising a matching circuit, the matching circuit comprises a switch and a plurality of the matching units, the switch comprises a common contact electronically connected to the ground end and a switch contact switching among the matching units or directly open.

* * * * *